United States Patent [19]

Agabekov

[11] Patent Number: 4,858,088

[45] Date of Patent: Aug. 15, 1989

[54] ELONGATED LIGHTING DEVICE

[76] Inventor: Youri Agabekov, 73 route de Thonon, 1222 Vésenaz, Switzerland

[21] Appl. No.: 203,644

[22] Filed: Jun. 1, 1988

Related U.S. Application Data

[63] Continuation of Ser. No. 833,407, Jan. 13, 1986, abandoned.

[30] Foreign Application Priority Data

May 15, 1984 [CH] Switzerland ..... 2383/84

[51] Int. Cl.[4] ..... F21S 3/00; H05B 33/02; F21V 5/00

[52] U.S. Cl. ..... 362/249; 362/223; 362/219; 362/227; 362/217

[58] Field of Search ..... 362/249, 223, 219, 227, 217, 362/225, 221, 222

[56] References Cited

U.S. PATENT DOCUMENTS

| | | | |
|---|---|---|---|
| 2,182,434 | 12/1939 | Hohl | 362/217 |
| 3,638,012 | 1/1972 | Lenz et al. | 362/227 |
| 4,158,221 | 6/1979 | Agabekov | 362/219 |
| 4,161,769 | 7/1979 | Elliott | 362/219 |
| 4,338,653 | 7/1982 | Marror | 362/217 |
| 4,521,888 | 6/1985 | Agabekov | 362/219 |
| 4,573,111 | 2/1986 | Herst et al. | 362/223 |
| 4,591,957 | 5/1986 | Harwood | 362/217 |

*Primary Examiner*—Raymond A. Nelli
*Attorney, Agent, or Firm*—Ostrolenk, Faber, Gerb & Soffen

[57] ABSTRACT

The present invention relates to an elongated lighting device, characterized by the fact that it comprises a housing having a bottom, two lateral wings, a longitudinally elongated opening adapted to receive a transparent closure, and an electric supply bar mounted on the bottom in the interior of the housing, so as to be enclosed between the lateral wings and to be placed in front of the elongated opening, the electric supply bar having at least one insulating support element whereon a succeeding series of electric contact pairs is mounted and which pairs are each destined to receive the connection contacts at the ends of a current consuming element such as a tubular electric lamp.

16 Claims, 2 Drawing Sheets

ELONGATED LIGHTING DEVICE

This is a continuation of Ser. No. 833,407, filed Jan. 13, 1986, now abandoned.

BACKGROUND OF THE INVENTION

The present invention generally relates to lamps and lighting fixtures, and more particularly to elongated ceiling and wall mounted lamps, or suspended and free-standing lamps, typically using fluorescent bulbs.

SUMMARY OF THE INVENTION

The present invention generally consists of a housing having an elongated longitudinal opening in which is mounted an electric supply bar having electrical contacts supported by an insulating element. A glass closure is placed along the opening to diffuse the light.

According to a preferred embodiment of the instant lighting device, an intermediate structure of an insulating material is inserted between the bottom and the insulating support element of the supply bar, one of the faces of the intermediate structure being fixed to a flat portion of the bottom of the housing which forms the lighting device; the other, opposing face serves as the mounting surface for the insulating support element of the bar, the inner height of the intermediate structure being chosen such as to allow the passage of at least one electric wire which will be connected to the power supply.

The intermediate structure may be a U-shaped structure whose free ends each bear a longitudinally extending groove, the grooves in the two free ends opening to as to face each other so that they can receive a closure platen which will serve as a support for the insulating support element.

The insulating support element may be provided with two flanges which are perpendicular to each other and connected by a central portion which forms an angle of 135° with each one of said flanges, and two conducting strips mounted on the backside of the two flanges of the insulating support. The conducting strips bear electric contacts going through corresponding slots in the insulating support element, every electric contact pair being formed by two contacts each of which is borne by a conducting strip.

The housing may comprise several supply bars mounted one after another in lengthwise direction of the housing, transformers being provided between each two successive supply bars, and an intermediate structure mounted between each bar and the housing. The housing of the lighting device also has two wings which define the opening; the wings may be provided with lengthwise grooves for receiving corresponding ribs of the glass covering the opening.

The lighting device may include masks for partially closing the opening of the housing, the glass closure being placed between these masks. The masks may also be provided with lengthwise ribs which are arranged so as to fit into the grooves of the opening of the housing. The lighting device may be provided with an adjustable spot light mounted on a mask, and provided with a spherical articulation in order to direct it to a predetermined direction.

Accordingly, the primary object of the invention is to provide an elongated lighting device that is easy to manufacture.

Another object of the invention is to provide such as device which is modular in nature.

Yet another object of the invention is to provide a lighting device which may selectively illuminate portions of a room.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following description of illustrative embodiments when read in conjunction with the accompanying drawings, wherein:

DESCRIPTION OF THE PREFERRED EMBODIMENT

Figure 1:
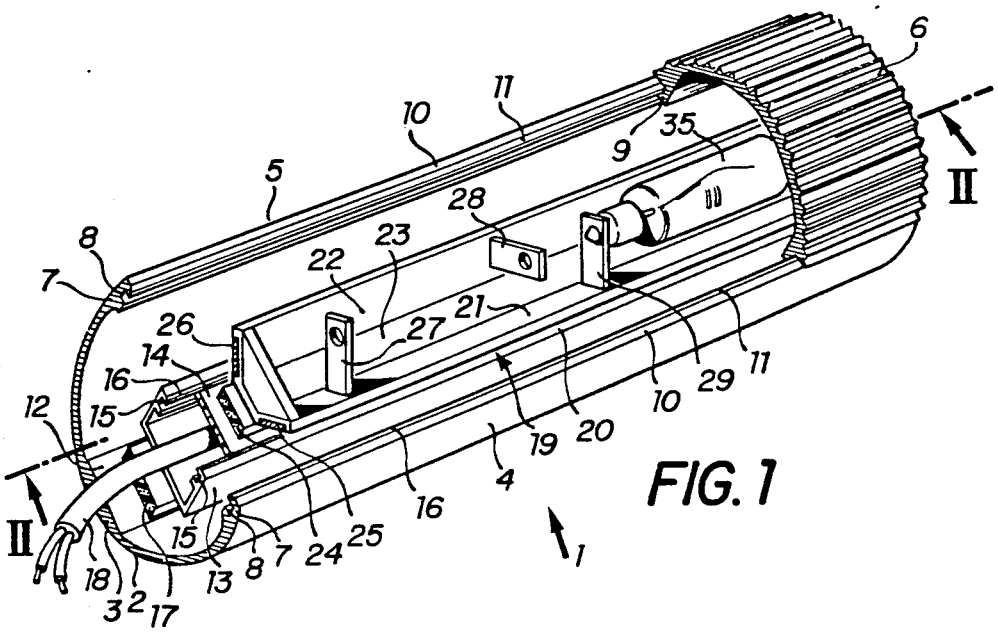
FIG. 1 is a perspective view of part of the elongated lighting device, and glass closure of the device being removed on part of its length.
Figure 4:
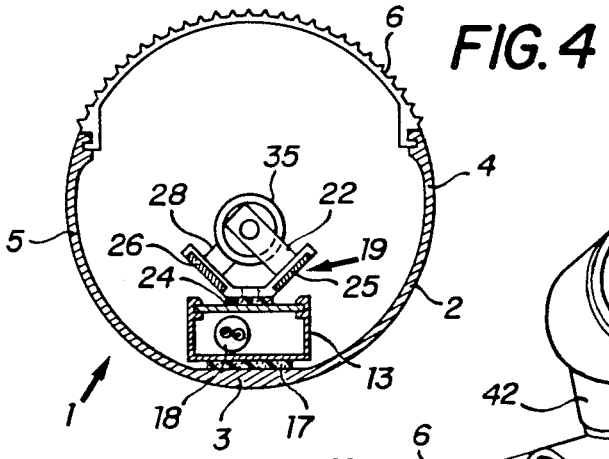
FIG. 4 is a transverse sectional view of the lighting device along line IV—IV of FIG. 3.

The elongated lighting device comprises sections 1 which are shown in FIGS. 1 to 8. They essentially consist of a housing 2 having substantially circular shape and comprising a bottom portion 3 and two lateral wing portions 4 and 5. The free ends of the wings 4 and 5 define an elongated opening covered by a protecting, light-transmitting closure 6. The housing 2 is generally made by extrusion of a light metal such as aluminum. This can be surface treated, such as by anodizing, and then shows a polished and colored surface. The housing may also be manufactured from plastic materials.

The free ends of the wing portions 4 and 5 of the housing 2 are reinforced, and this reinforcement 7 is fitted with a groove 8 adapted to receive a corresponding tongue 9 of the protecting closure 6. The grooves 8 are made laterally in the reinforced ends 7 of the wings 4 and 5 of the housing 2 and are thus facing one another. The reinforced portions 7 of the said free ends finish in a plane surface 10 and a beveled portion 11 which faces the interior of the housing 2. This beveled portion 11 facilitates positioning the protecting closure 6 facing the opening of the housing, and to introduce the tongues 9 into the corresponding grooves 8 by simply applying a pressure on the protecting closure 6. The protecting closure 6 should of course have a certain flexibility, and its manufacture from plastic materials is preferred.

In the embodiment of FIGS. 1 to 8, the housing 2 and the protecting closure 6 have a circular configuration. It will be evident that the housing 2 and the protecting closure 6 may also be made of other materials than light metals and plastics, for example of chromium-plated or zinc-plated metal sheets, and may have another shape than the represented one, for example a rectangular or squared section.

As shown in FIGS. 1 to 8 of the drawing, the bottom portion 3 of the housing 2 has a flat portion 12 whereon an intermediate structure 13 is fixed which has a generally U-shaped cross-section closed by a plate 14. The plate 14 is inserted into lateral grooves 15 of the free ends of the intermediate structure 13. The upper portion of the lateral free ends of the intermediate structure 13 are also provided with a beveled portion 16 facing the interior of intermediate structure 13, and which allows the insertion of the plate 14 in the grooves 15 by a simple pressure applied on the top side of the plate 14 when it has been positioned onto the intermediate structure 13. The intermediate structure 13 is secured to the flat portion 12 via an adhesive ribbon 17. The intermediate structure 13 serves to receive power supply wires 18.

An electric supply bar 19 is fixed on the closure plate 14 so as to be opposite to the opening of the lighting device which is limited by the wing portions 4 and 5 of the housing 2. The electric supply bar 19 comprises an insulating support 20 made by a molding process from plastic material. The insulating support 20 is further provided with two flat flanges 21 and 22, perpendicular to one another and connected by a flat central web 23 which forms an angle of 135° with each of the flanges 21 and 22. The central web 23 is fixed to the plate 14 of the intermediate structure 13 by an adhesive ribbon 24. Conductor strips 25 and 26 are placed against the back of the flanges 21 and 22 of the insulating bar 19. The conductor strips 25 and 26 are connected to electric contact pairs 27, 28; 29, 30; 31, 32; 33, 34; and so on. Each electric contact pair is adapted to receive an electric current consuming element such as a tubular lamp 35 (FIG. 1) or a halogen lamp mounted in an adapter (not shown). The supply bar 19 is the subject of Swiss patent No. 652,537 (application No. 2119/83-6, filed on April 20, 1983).

There are also commercially available adapters which may be placed between the electric contact pairs 27, 28; 29, 30; etc. and which allow the use of halogen lamps. These adapters are disclosed in Swiss patent specification No. 654,094, which corresponds to U.S. Pat. No. 4,569,568.

Figure 2:
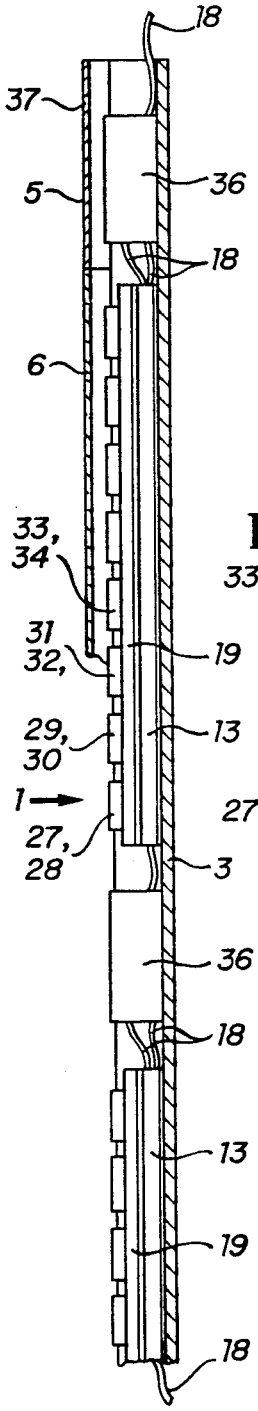
FIG. 2 is a lengthwise sectional view of the lighting device, along line II—II of FIG. 1.
Figure 3:
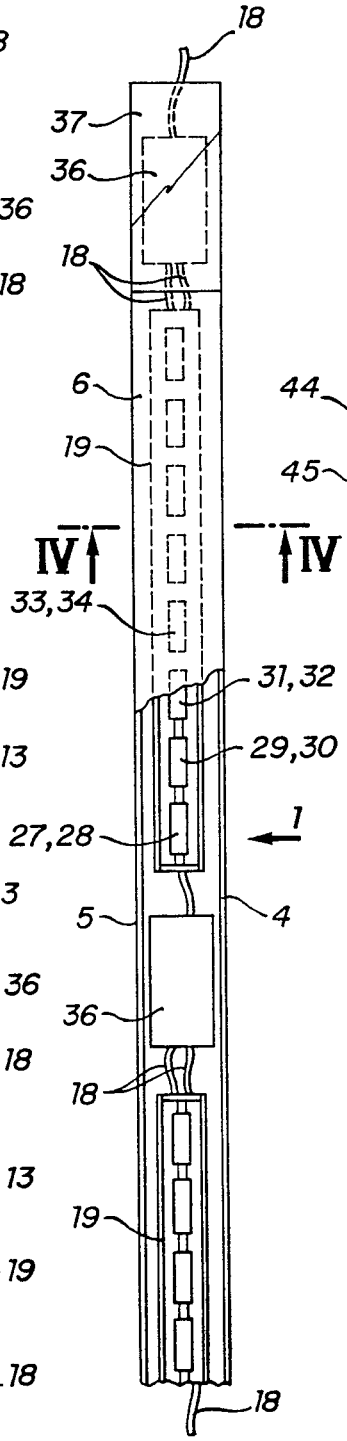
FIG. 3 is a plan view of the lighting device as represented in FIG. 2.

The elongated lighting device, a section of which is shown in FIG. 1, may have a total length of several meters as can be seen from FIGS. 2 and 3. In these figures, a lighting section having two electric supply bars 19 is shown. Transformers 36 are mounted between two supply bars 19, each transformer 36 having appropriate specifications according to the current consuming elements of a supply bar 19. The transformers 36 are supplied by conductors 18 which carry typical line voltage, namely 220 volts in Europe and about 110 volts in the United States. As it is shown in FIGS. 2 and 3, intermediate structures 13 are inserted between the supply bars 19 and the housing 2 of the lighting device so as to allow the passage of power supply wires 18. The transformers 36 will be hidden by masks 37 which will be made from the same material as the housing 2 of the lighting device, and only the portions which are located over the supply bars 19 will be covered by a protecting closure 6. The masks 37 will be described later with reference to FIG. 5.

The lighting device, which has been described with reference to FIGS. 1 to 4, has generally a diameter of a few centimeters and, as has already been mentioned, may have a length of several meters. The actual length will be selected according to the user's needs and the unit lengths of the electric supply bars 19. The housing 2 being generally made by extrusion, it is only necessary to cut the extruded housing to its convenient length and to mount in its interior the intermediate structures 13, the transformers 36, and the supply bars 19. The masks 37 as well as the protecting closure 6, will also be supplied to the customer as elements of several meters' length which may thus also be cut as required. The lighting device may be cut at 90° to its axis or at 45°, and then the pieces may be assembled such as to form, for example, a lighting frame for a door or a showcase. It can, of course, be cut at other angles than 90° or 45° for assembling appropriate geometric figures, such as hexagons, or broken lines, depending on the user's desires. In the case where halogen lamps are mounted between the contact pairs 27, 28; 29, 30; etc., with the aid of the above-mentioned adapters, very intensive and interesting lightings may be obtained for special purposes, for example, the illumination of shop showcases. Portions of the lighting device may also be placed side by side in order to form a lighted surface, or these lighted surfaces may be mounted at the exterior of a periphery such as to obtain special lamps or lighting devices.

Figure 5:
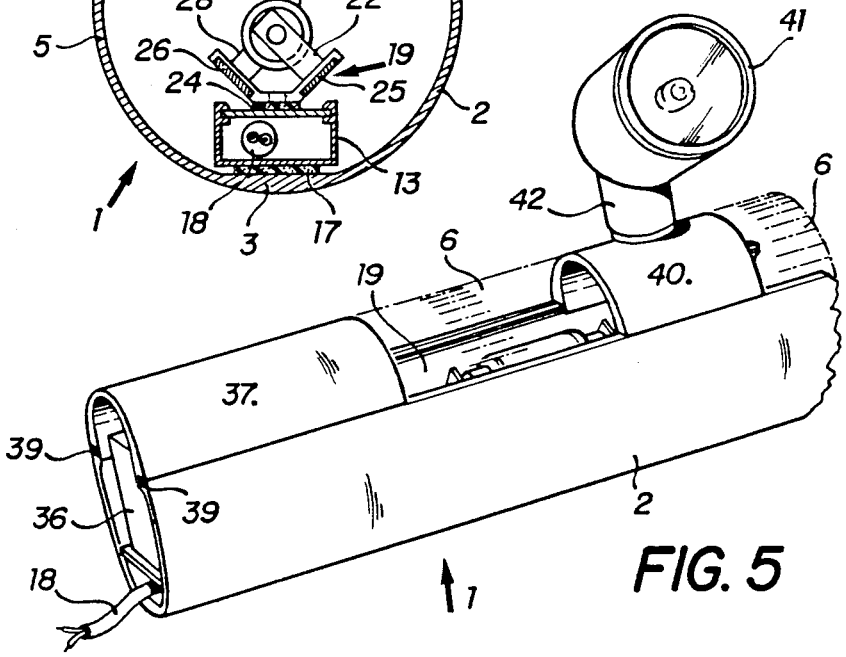
FIG. 5 is a perspective view of the lighting device, having a cover fitted with an adjustable spot light.

In FIG. 5, a portion of a lighting device 1 similar to that of FIGS. 1 to 4 is shown. The portion of FIG. 5 comprises a housing 2 enclosing the already described intermediate structure 13 and the electric supply bar 19. As has already been mentioned, the connecting cable 18 is connected to a transformer 36 hidden by a mask 37. The mask 37 is made of the same material as the housing 2 of the lighting device 1 and has the same configuration as the protecting light-transmitting closure 6 with ribs 39 by which it may be inserted into the corresponding grooves 8 of the housing 2.

The portion of FIG. 5 comprises another mask 40, shorter than the mask 37, bearing a spot light 41. This spot light 41 is adjustable in several planes and may be directed in any direction whatsoever; it is connected to the mask 40 by an intermediate ball-and-socket joint 42. The length of the mask 40 approximately corresponds to the distance between two adjacent contacts of a contact pair 27, 28; 29, 30; etc., so that the mask 40 may be mounted exactly over a contact pair, e.g., the contacts of the pair 27, 28, which will then be used to supply spot light 41. If adjacent contact pairs at the right or the left are used in a normal way, by tubular lamps or by elongated halogen lamps, protecting closures 6 will be mounted on both sides of the mask 40.

Figure 6:
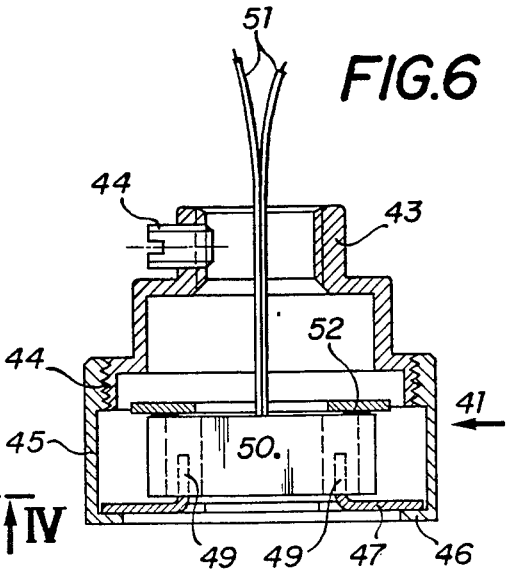
FIG. 6 is a transverse sectional view of the adjustable spot light shown in FIG. 5.
Figure 7:
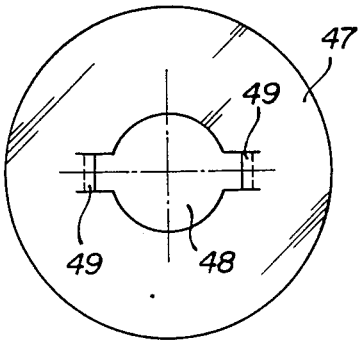
FIG. 7 is a view of a positioning washer used in the spot light of FIG. 6.
Figure 8:
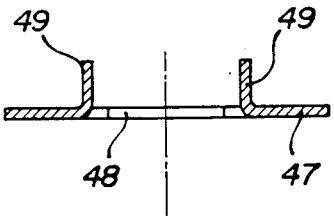
FIG. 8 is a lateral view of the positioning washer shown in FIG. 7.

The adjustable spot light 41 as represented in FIGS. 6 to 8, comprises a socket 43 which will be fixed by a screw 44 to the spherical joint 42 which is attached to the mask 40. The socket 43 has a thread 44a which receives the corresponding part of a cylindrical jacket 45. This jacket 45 has a rim 46 at its free end to retain a positioning washer 47. The positioning washer 47 is shown in detail in FIGS. 7 and 8 and has a central opening 48 and two positioning legs 49. As shown in FIG. 6, the positioning legs enter in corresponding holes of an insulating pellet 50 comprising the female connections (not shown) for receiving a light bulb. The female connections (not shown) are connected to electric wires 51 which will be connected to electrical contacts of the supply bar 19. The insulating pellet 50 is tightened between the washer 47 and another washer 52 applied against the socket 43.

The adjustable spot light 41 which has been described with reference to FIGS. 5 to 8, represents an interesting accessory part of the lighting device of FIGS. 1 to 4. In fact, it allows the addition, at any desired location of the lighting device, of an adjustable spot light whose light can be directed to a location which the user desires to illuminate. Several spot lights may, of course, be arranged over the length of the lighting devices of FIGS. 1 to 5.

As has already been mentioned, the lighting device as described will be manufactured from an extruded light metal housing. The masks 37, 40 are also made from the same material and in principle the same way. The light transmitting closures 6 will be prepared from transparent or translucent plastic. When a closure is provided, it can also be made from a light metal. A person skilled in the art will be aware that the described lighting device may also fully be made, if a low-cost execution and model is contemplated, from plastic materials. On the other hand, the circular tube section is not a necessary condition, and the profile of the lighting device may present a rectangular, squared, or even oval or elliptic section.

The basic idea which has led to the conception of the instant lighting device was the combination of a profile (housing) having a relatively thin and light structure and a great length, with an electric lamp fixture bar such as disclosed in Swiss patent specification No. 654,094, which corresponds to U.S. Pat. 4,569,568. One of the important features of the instant lighting device is the presence of an intermediate structure allowing the passage of electric supply wires carrying domestic current, inserted between the very housing 2 of the lighting device and the fixture bar 19. This disposition allows the portion-by-portion supply of succeeding sections of the lighting device by appropriate tiny transformers.

I claim:

1. An elongated lighting device, comprising:

a housing having a bottom, two lateral wings, a longitudinal opening for receiving a light-transmitting closure, and electric supply means mounted on said bottom in the interior of said housing, such as to be enclosed between said lateral wings and placed in front of said longitudinal opening, said electric supply means comprising at least one insulating support element for receiving a succeeding series of electric contact pairs mounted thereon, each said electric contact pair being adapted to receive the electric connections at the end of a current consuming element such as a tubular electric lamp, wherein said electric supply means further comprises an intermediate structure of insulating material, inserted between said housing bottom and said insulating support element, and having a bottom portion and a top portion, said bottom portion of said intermediate structure being fixed to said bottom of said housing, said top portion comprising means for mounting said insulating support element thereon, an inner height of said intermediate structure being chosen so as to allow the passage of at least one electric wire to be connected to a power supply.

2. The lighting device of claim 1, wherein said bottom of said housing has a flat portion for attachment to said insulating support element.

3. The lighting device of claim 1, wherein said intermediate structure has a U-shaped cross-section including a central flat portion fixed to said flat portion of said bottom of said housing, and a pair of free ends which have lengthwise extending grooves, said grooves facing one another for receiving a plate which supports said insulating support element.

4. The lighting device of claim 1, wherein said insulating support element is provided with two flanges having front and rear sides, said flanges being perpendicular to each other, connected by a central flat web which forms an angle of substantially 135° with each of the flanges, a respective conducting strip being mounted on said rear side of each of said flanges, said conducting strips being attached to electric contacts which extends through corresponding slots of said insulating support element, thereby forming said succeeding series of electric contact pairs, each said electric contact pair having one contact attached to each of said conducting strips.

5. The lighting device of claim 1, wherein said insulating support element is fixed to the bottom of the housing by an adhesive strip.

6. The lighting device of claim 1, wherein said intermediate structure is fixed to said bottom of said housing by a first adhesive strip, and said insulating support element is fixed to said intermediate structure by a second adhesive strip.

7. The lighting device of claim 1, wherein each of said lateral wings of said housing is provided with a lengthwise groove for receiving a corresponding tongue attached to and integral with said closure.

8. The lighting device of claim 1, wherein said housing has a circular cross-section.

9. The lighting device of claim 7, wherein said masks have lengthwise ribs arranged in such a manner that said ribs may be inserted into grooves running longitudinally along said opening of said housing.

10. An elongated lighting device, comprising:

a housing having a bottom, two lateral wings, a longitudinal opening for receiving a light-transmitting closure, and electric supply means mounted on said bottom in the interior of said housing, such as to be enclosed between said lateral wings and placed in front of said longitudinal opening, said electric supply means comprising at least one insulating support element for receiving a succeeding series of electric contact pairs mounted thereon, each said electric contact pair being adapted to receive the electric connections at the end of a current consuming element such as a tubular electric lamp, wherein a plurality of said electric supply means are longitudinally mounted in said housing in succeeding relationship, and further comprising a corresponding plurality of transformers placed between adjacent respective supply means, wherein each said transformer connects said respective wire of said supply means to said power supply, and wherein respective intermediate structures are provided between each of said supply means and said housing.

11. An elongated lighting device, comprising:

a housing having a bottom, two lateral wings, a longitudinal opening for receiving a light-transmitting closure, and electric supply means mounted on said bottom in the interior of said housing, such as to be enclosed between said lateral wings and placed in front of said longitudinal opening, said electric supply means comprising at least one insulating support element for receiving a succeeding series of electric contact pairs mounted thereon, each said electric contact pair being adapted to receive the electric connections at the end of a current consuming element such as a tubular electric lamp, further comprising a plurality of masks for partially closing said opening of said housing, said closures being placed between succeeding masks.

12. The lighting device of claim 11, wherein said masks have lengthwise ribs arranged in such a manner that said ribs may be inserted into grooves running longitudinally along said opening of said housing.

13. The lighting device of claim 11, further comprising an adjustable spot light mounted on one of said masks.

14. The lighting device of claim 13, wherein said adjustable spot light is mounted on said mask by means of a spherical articulation allowing adjustment of said spot light in a plurality of directions.

15. The lighting device of claim 13, wherein said adjustable spotlight comprises a socket whereon a cylindrical jacket is screwed, an insulating pellet having two female contacts for receiving pins of an electric lamp being tightened between said socket and said cylindrical jacket.

16. The lighting device of claim 15, wherein a positioning washer is inserted between said insulating pellet and said cylindrical jacket, said washer having two legs inserted into holes provided in the pellet, said washer having an outer diameter which corresponds to the inner diameter of said cylindrical jacket.

* * * * *